United States Patent [19]

Lanese

[11] 4,120,672

[45] Oct. 17, 1978

[54] RAPPER ASSEMBLY FOR ELECTROSTATIC PRECIPITATORS

[75] Inventor: Philip M. Lanese, Belle Mead, N.J.

[73] Assignee: Belco Pollution Control Corporation, Parsippany, N.J.

[21] Appl. No.: 755,521

[22] Filed: Dec. 30, 1976

[51] Int. Cl.[2] ..... B03C 3/76

[52] U.S. Cl. ..... 55/112; 55/139; 173/117

[58] Field of Search ..... 55/13, 112, 139, 300; 173/2, 117; 310/30; 318/122, 132, 114; 361/139, 416; 335/255; 323/225 C

[56] References Cited

U.S. PATENT DOCUMENTS

| | | | |
|---|---|---|---|
| Re. 22,314 | 5/1943 | Dawson | 318/132 |
| 2,568,757 | 9/1951 | Mesh | 310/29 |
| 2,634,818 | 4/1953 | Wintermute | 55/112 |
| 3,336,537 | 8/1967 | Reich | 331/116 M |
| 3,346,780 | 10/1967 | Klix | 318/132 |
| 3,504,480 | 4/1970 | Copcutt et al. | 55/112 |
| 3,605,915 | 9/1971 | Gately et al. | 55/112 |

FOREIGN PATENT DOCUMENTS

| | | | |
|---|---|---|---|
| 593,803 | 3/1960 | Canada | 55/112 |

*Primary Examiner*—Frank W. Lutter
*Assistant Examiner*—David L. Lacey
*Attorney, Agent, or Firm*—Marvin A. Naigur; John E. Wilson; John J. Herguth, Jr.

[57] ABSTRACT

An electrode rapper assembly for electrostatic precipitators which increases the life of switches used to energize the rapper and will not be damaged if improperly connected. The rapper assembly has a solenoid and two diode rectifiers, one being connected in parallel with the solenoid coil and the other in series with the coil.

5 Claims, 4 Drawing Figures

RAPPER ASSEMBLY FOR ELECTROSTATIC PRECIPITATORS

BACKGROUND OF THE INVENTION

Electrostatic precipitators which use a plurality of electrodes to remove particulate matter must be cleaned periodically during operation if they are to function with any reasonable efficiency. Otherwise, the electrodes will become coated with the matter which has been removed from the air or other gas circulating through the precipitator and will no longer attract the particulate matter with any reasonable degree of efficiency.

A common way to clean the electrodes is to provide rappers which are connected with one or more electrodes. While the precipitator is in operation, each rapper is periodically operated to rap the electrode or electrodes causing the particulate matter to drop off. Each rapper is conventionally composed of a solenoid containing a core which strikes an anvil when the solenoid is energized. The anvil is connected with one or more electrodes which are vibrated when the anvil is struck by the core.

It is a common practice to seal the coil of each solenoid with varnish except for electrical conductors, usually wires, which must be accessible for connecting the coils to a power source. The varnish protects the solenoid coil from the moisture present during and after construction of the precipitator.

A serious problem has been encountered in the use of such electromagnetic rappers. In some instances a current is induced in the solenoid coil when the energizing current is discontinued. As the flux deteriorates, the induced electromagnetic force causes the current to flow out of the coil. This induced voltage is problematic because it can damage the switching device used to discontinue the current supply to the rapper.

It has been found in practice that the contacts of the switches deteriorate due to the arcing caused by the voltage induced at the coil. Consequently, the contacts have to be carefully maintained for reliable services.

The phenomenon discussed above has produced a somewhat similar problem when solid state devices have been substituted for the mechanical contacts. The problem is compounded when solid state devices are used to control rectified alternating current for distribution to the solenoids because it is impossible to directly interrupt rectified current flow to the solenoids.

SUMMARY OF THE INVENTION

It is an object of the present invention to overcome drawbacks in the prior art such as those discussed above. Accordingly, an electrode rapper assembly for electrostatic precipitators is provided with a first junction, a second junction, a solenoid coil connected between the first and second junctions, an anvil and a ferro-magnetic plunger, a series rectifier connected in series with the coil so that one of the junctions is between the coil and the series rectifier, and current flowing through the series rectifier can pass only from the first junction and through the series rectifier to the second junction, and a parallel rectifier connected between the first and second junctions and across the coil permitting current flow from the second junction and through the parallel rectifier to its first junction whereby current can flow through the series rectifier and coil to lift the plunger and interruption of the current will allow the plunger to fall and come to rest, the movement of the plunger creating vibrations and any current induced in the coil upon interruption of the current will flow only through said coil and said parallel rectifier until dissipated.

DETAILED DESCRIPTION OF THE PREFERRED EMBODIMENT

Figure 1:
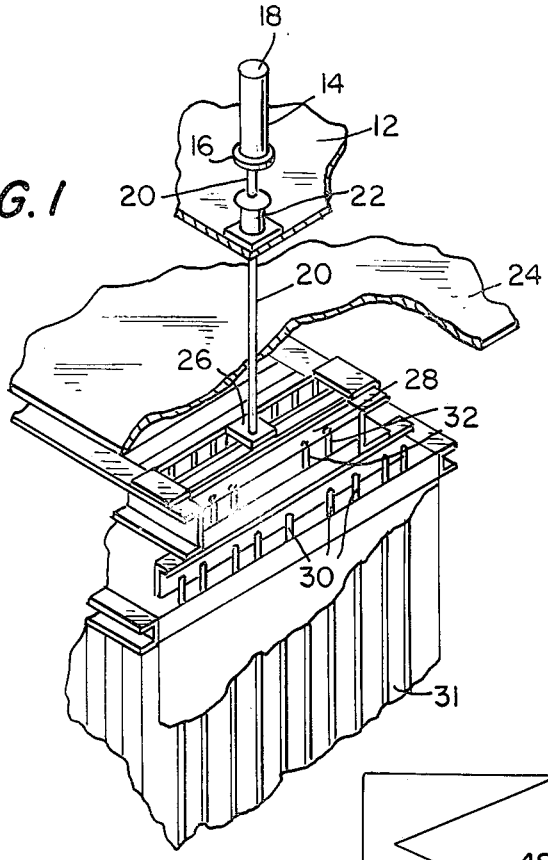
FIG. 1 is a fragmentary view, partly in section, showing a rapper assembly connected with electrodes in an electrostatic precipitator.

In FIG. 1 a rapper assembly, indicated generally as 10, is shown mounted above the roof 12 of an electrostatic precipitator. The rapper assembly 10 includes an outer cylindrical cover 14 having an anvil 18 at its upper end. The rapper assembly 10 is mounted on top of a support rod 20 which extends down from the rapper assembly 10 through a vertical guide bearing 22 which is secured to the top of the roof 12. The rod 20 extends downward through the top of a ceiling 24 to a horizontal end plate 26. The end plate 26 is secured to several cross beams 28. From some of the cross beams extends rod-like hangars 30 which support a number of flat electrodes 31 while electrodes in the form of wires 32 hang from alternately spaced cross beams 28. The electrodes 31 and 32 are energized in a conventional manner. Thus, if the rapper assembly is energized so that its associated support rod 20 is vibrated, the support rod will vibrate one or more cross beams 28 which will convey the impulse to an electrode or electrodes connected with that cross beam.

Figure 2:
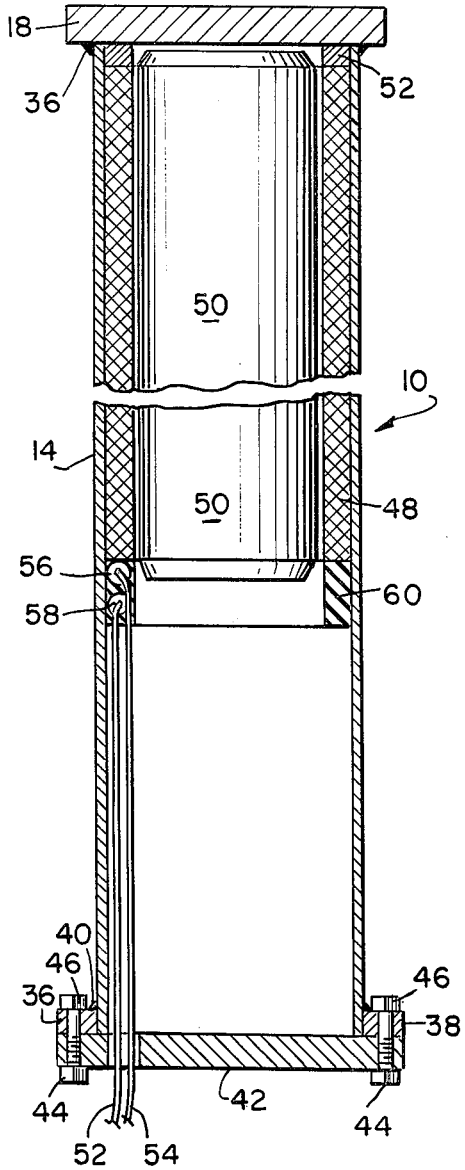
FIG. 2 is a view, partly in section, of a rapper assembly.
Figure 3:
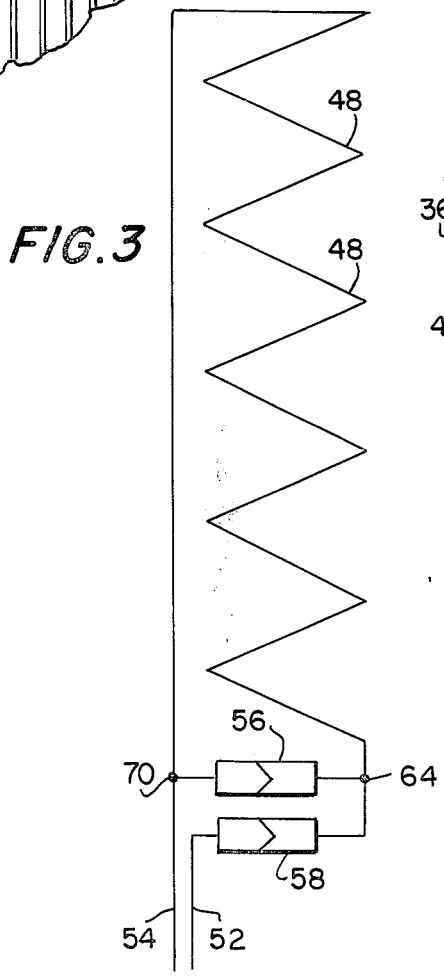
FIG. 3 is a view showing how the diodes and coil of the rapper assembly are wired.

FIG. 2 shows in some detail a rapper assembly 10. As pointed out above, rapper assembly 10 has a outer cylindrical cover 14. The cylindrical cover 14 is closed at one end by the avil 18 which is welded about its periphery at 36 to the end of the cover 14.

The other end of the cover 14 has a flange 38 which is welded at 40 to provide a means to secure an end closure 42 to that end. Bolts 44 project through the flange 38 and end closure 42 and have nuts 46 threaded on their ends to secure the end closure 42 to the flange 38.

A solenoid coil 48 fits snuggly within the cover 14 so that it is adjacent to the anvil 18. A ferro-magnetic core or plunger 50 is positioned within the coil 48 so that it can move axially. When the coil is energized, the ferro-magnetic plunger is accelerated toward the anvil 18 to strike it and bounce downward. The coil is then de-energized so that the plunger drops against the end closure 42 and comes to rest. Thus, the anvil 18 receives the impulse transmitted by the moving plunger.

In order to provide for the flux necessary to raise the plunger, the cover 14, anvil 18, end closure 42 as well as the plunger 50 are of ferro-magnetic material so that the flux lines extend through these members. A stainless steel disc 52 is provided between the anvil 18 and the plunger 50 so that when the coil is de-energized, the magnetic field will quickly decay and permit the plunger to drop.

The solenoid is energized by means of rectified alternating current flowing through conductors in the form of lead wires 53 and 54. A parallel rectifier in the form of a solid state diode 56 and a series rectifier in the form of a solid state diode 58 are embedded in insulating material 60 adjacent to the lower end of the solenoid coil 48.

Figure 4:
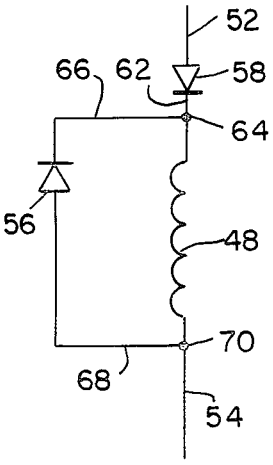
FIG. 4 is a schematic view of the electrical circuit of the present rapper assembly.

The electrical circuit, shown best perhaps in FIG. 4, includes the lead wires 53 and 54. The diode 58 is connected to the lead wire 53 and to wire 62 which leads to junction 64. A wire 66 connects the junction 64 to the diode 56 and a wire 68 connects the diode 56 to a junction 70 which is connected to the solenoid 48 so that the solenoid is connected between the junctions 64 and 70. The lead wire 54 is connected to the junction 70.

The solenoid coil 48 is energized by rectified alternating current passing through lead wire 53, diode 58, wire 62, junction 64, solenoid coil 48, junction 70 and lead wire 54. The energizing current will not pass through wires 66 and 68 to by-pass the coil 48 because the diode 56 prevents flow of current in the direction of the energizing current. Energization of the coil 48 raises the plunger 50 to collide with the anvil 18. Interruption of the energizing current through the lead wire 53 will cause collapse of the magnetic field in the rapper assembly 10 and consequently, the plunger 50 will drop.

It is the interruption of current through the coil 48 that causes the induced current which has in the past caused deterioration of the device used to discontinue the energizing current. The induced current is dissipated to avoid such deterioration. This is accomplished by use of the present circuit in each assembly where the induced current cannot pass through the wires 53 and 54 to damage any switches used to establish and interrupt continuity with the power source. The induced current passes from coil 48 through the junction 70, the wire 68, the diode 56, the wire 66, the junction 64 and back to the coil 48 until dissipated. None of the induced current will leave the rapper assembly 10 but will flow within the assembly until dissipated. Since no induced current leaves the rapper assembly 10, any interfering current in the system is avoided and therefore, it is possible to immediately apply power to any other rapper assembly in the electrostatic precipitator.

Another advantage of the present rapper assembly is that if it is inadvertently connected improperly, it will not be damaged when an attempt is made to operate it. If, by accident the lead wires 53 and 54 were reversed when the rapper was installed, the application of an energizing voltage across the rapper assembly will not damage the diode 56 because the diode 58 will prevent the flow of current in a direction opposite to that in which the current would flow if the lead wires 53 and 54 were properly connected.

The foregoing describes but one embodiment of the present invention, other embodiments being possible without exceeding the scope thereof.

What is claimed is:

1. An electrode rapper assembly for electrostatic precipitators comprising:

a cylindrical cover;

a coil within said cover and concentric therewith;

an anvil rigidly connected with said cover;

a ferro-magnetic plunger movably mounted within said coil and movable to strike said anvil;

a first junction;

a second junction, said coil being connected between said first and second junctions;

a series solid state rectifier diode;

a parallel solid state rectifier diode;

a wire connecting one end of said parallel solid state rectifier diode with said first junction and another wire connecting the other end of said parallel rectifier diode to said second junction so as to be in parallel with said coil and permit current flow through said parallel rectifier diode so that it passes from said second junction through said parallel rectifier diode to said first junction;

two conductors for supplying rectified A. C. current, one of said conductors being connected to one of said junctions, the other of said conductors being connected to one end of said series rectifier diode; and a wire connecting the other end of said series rectifier diode with the other of said junctions so that current passing through said series rectifier diode can pass only from said first junction to said second junction while passing through said coil;

whereby energizing current can flow through said coil to generate a magnetic field and move said plunger upward and interruption of said energizing current will permit said plunger to drop, the current induced in said coil upon said interruption flowing through said second junction, said parallel rectifier, said first junction and said coil until dissipated.

2. The rapper assembly defined in claim 1 wherein each of said rectifiers is embedded in a plastic material within said rapper assembly.

3. The rapper assembly defined in claim 1 wherein said cover is of a ferro-magnetic material, and is closed at one end and the other end is closed by said anvil.

4. The rapper assembly as defined in claim 1 wherein said diodes are within said cover and located laterally of said plunger.

5. The rapper assembly defined in claim 4 wherein said diodes are adjacent to and below said coil.

* * * * *